US009127561B2

(12) United States Patent
Boyer

(10) Patent No.: US 9,127,561 B2
(45) Date of Patent: Sep. 8, 2015

(54) TURBINE BUCKET WITH CONTOURED INTERNAL RIB

(75) Inventor: Bradley Taylor Boyer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 731 days.

(21) Appl. No.: 13/409,375

(22) Filed: Mar. 1, 2012

(65) Prior Publication Data

US 2013/0230408 A1 Sep. 5, 2013

(51) Int. Cl.
*F01D 5/18* (2006.01)

(52) U.S. Cl.
CPC ..... *F01D 5/187* (2013.01); *F05D 2260/22141* (2013.01)

(58) Field of Classification Search
CPC ..... F01D 5/18; F01D 5/186; F01D 5/187; F01D 5/188
USPC ..... 415/115; 416/95, 96 R, 97 R
See application file for complete search history.

(56) References Cited

U.S. PATENT DOCUMENTS

| | | | | |
|---|---|---|---|---|
| 3,528,751 | A * | 9/1970 | Davis et al. | 415/115 |
| 4,526,512 | A * | 7/1985 | Hook | 416/96 A |
| 5,340,278 | A | 8/1994 | Magowan | |
| 5,344,283 | A | 9/1994 | Magowan et al. | |
| 5,382,135 | A | 1/1995 | Green | |
| 5,848,876 | A | 12/1998 | Tomita | |
| 6,071,075 | A | 6/2000 | Tomita et al. | |
| 6,190,130 | B1 | 2/2001 | Fukue et al. | |
| 6,341,939 | B1 | 1/2002 | Lee | |
| 6,390,774 | B1 | 5/2002 | Lewis et al. | |
| 6,481,967 | B2 | 11/2002 | Tomita et al. | |
| 6,572,329 | B2 * | 6/2003 | Tiemann | 415/115 |
| 6,805,534 | B1 * | 10/2004 | Brittingham | 416/97 R |
| 7,137,781 | B2 * | 11/2006 | Harvey et al. | 416/96 A |
| 7,147,439 | B2 | 12/2006 | Jacala et al. | |
| 7,255,536 | B2 | 8/2007 | Cunha et al. | |
| 7,273,350 | B2 * | 9/2007 | Kopmels et al. | 416/96 R |
| 7,416,391 | B2 | 8/2008 | Veltre et al. | |
| 7,597,536 | B1 | 10/2009 | Liang | |
| 7,762,784 | B2 * | 7/2010 | Propheter-Hinckley | 416/224 |
| 7,766,606 | B2 | 8/2010 | Liang | |
| 2007/0189896 | A1 | 8/2007 | Itzel et al. | |

(Continued)

FOREIGN PATENT DOCUMENTS

| | | | |
|---|---|---|---|
| CN | 101131095 | A | 2/2008 |
| CN | 101550843 | A | 10/2009 |

(Continued)

OTHER PUBLICATIONS

U.S. Appl. No. 12/878,075, filed Sep. 9, 2010, Boyer.

(Continued)

*Primary Examiner* — Nathaniel Wiehe
*Assistant Examiner* — Kayla McCaffrey
(74) *Attorney, Agent, or Firm* — Sutherland Asbill & Brennan LLP

(57) ABSTRACT

A turbine bucket may include a platform and an airfoil extending from the platform. The airfoil may include an internal rib with a number of through holes positioned along a number of hole spaces and a number of in-between spaces. The in-between spaces may include a first depth, the hole spaces may include a second depth, and wherein the first depth is less than the second depth.

11 Claims, 4 Drawing Sheets

(56) References Cited

U.S. PATENT DOCUMENTS

| | | | |
|---|---|---|---|
| 2010/0129213 | A1 | 5/2010 | Strohl et al. |
| 2011/0123310 | A1 | 5/2011 | Beattie et al. |
| 2011/0223004 | A1 | 9/2011 | Lacy et al. |

FOREIGN PATENT DOCUMENTS

| | | | |
|---|---|---|---|
| CN | 202023597 | U | 11/2011 |
| TW | 200506175 | | 2/2005 |

OTHER PUBLICATIONS

U.S. Appl. No. 12/972,835, filed Dec. 20, 2010, Harris, Jr., et al.

Chinese Office Action dated May 6, 2015 for Application No. CN 201310066022.3.

* cited by examiner

TURBINE BUCKET WITH CONTOURED INTERNAL RIB

TECHNICAL FIELD

The present disclosure relates generally to gas turbine engines and more particularly relate to a gas turbine engine with a turbine bucket having an airfoil with a contoured internal rib about a leading edge thereof so as to reduce stress therein due to thermal expansion.

BACKGROUND OF THE INVENTION

Known gas turbine engines generally include rows of circumferentially spaced nozzles and buckets. A turbine bucket generally includes an airfoil having a pressure side and a suction side and extending radially upward from a platform. A hollow shank portion may extend radially downward from the platform and may include a dovetail and the like so as to secure the turbine bucket to a turbine wheel. The platform generally defines an inner boundary for the hot combustion gasses flowing through a gas path.

Various types of cooling schemes have been used to keep the components of the turbine bucket within operational ranges so as to promote component lifetime. These cooling schemes, however, may promote localized regions of temperature differentials that may lead to thermally induced strain. For example, an airfoil may have a number of internal ribs with internal cooling holes therethrough for the passage of a cooling medium. One such rib may be positioned about the leading edge of the airfoil so as to provide the cooling medium via the internal cooling holes for impingement cooling. The internal rib thus may be highly cooled by the cooling medium but connected to the relatively hot airfoil walls. Such a high temperature differential therein may cause a thermal strain to develop in the internal rib. This strain may be amplified by stress concentration factors associated with the internal cooling holes such that the stress may impact on component lifetime. Although attempts have been made to control the temperature differentials, temperature control techniques generally require additional cooling flows at the expense of engine efficiency.

There is thus a desire for an improved turbine bucket for use with a gas turbine engine. Preferably such a turbine bucket may have an airfoil that may limit the internal stresses caused by a temperature differential therein without excessive manufacturing and operating costs and without excessive cooling medium losses for efficient operation and an extended component lifetime.

SUMMARY OF THE INVENTION

The disclosure thus provides an example of a turbine bucket. The turbine bucket may include a platform and an airfoil extending from the platform. The airfoil may include an internal rib with a number of through holes positioned along a number of hole spaces and a number of in-between spaces. The in-between spaces may include a first depth, the hole spaces may include a second depth, and wherein the first depth is less than the second depth.

The disclosure further provides an example of a turbine bucket with a cooling medium flowing therethrough. The turbine bucket may include a platform and an airfoil extending from the platform. The airfoil may include an internal rib positioned about a leading edge thereof. The airfoil may include an internal rib with a number of through holes positioned along a number of hole spaces and a number of in-between spaces. The in-between spaces may include a first depth, the hole spaces may include a second depth, and wherein the first depth is less than the second depth.

The disclosure further provide an example of a turbine bucket with a cooling medium flowing therethrough. The turbine bucket may include a platform and an airfoil extending from the platform. The airfoil may include an internal rib positioned about a leading edge thereof. The internal rib may include a number of through holes. The internal rib also may include a number of thick hole spaces with the through holes and a number of thin in-between spaces without the through holes.

These and other features and improvements of the present disclosure will become apparent to one of ordinary skill in the art upon review of the following detailed description when taken in conjunction with the several drawings and the appended claims.

DETAILED DESCRIPTION

Figure 1:
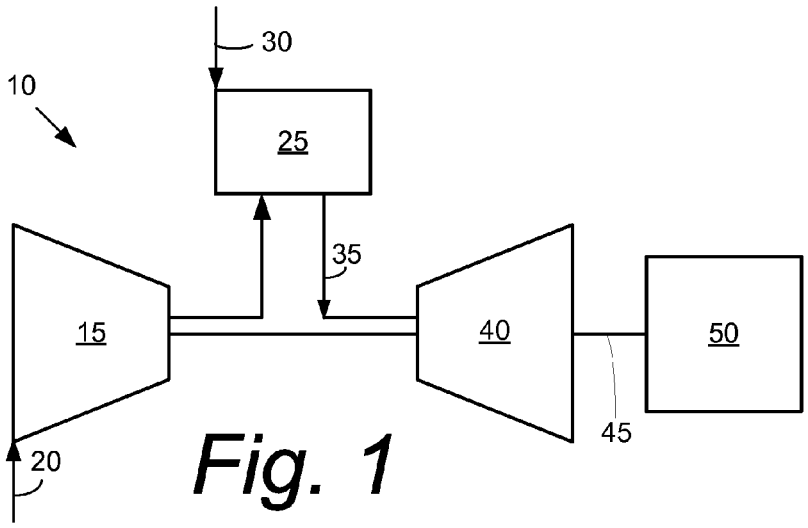
Fig. 1 (Prior Art)
FIG. 1 is a schematic diagram of a gas turbine engine with a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
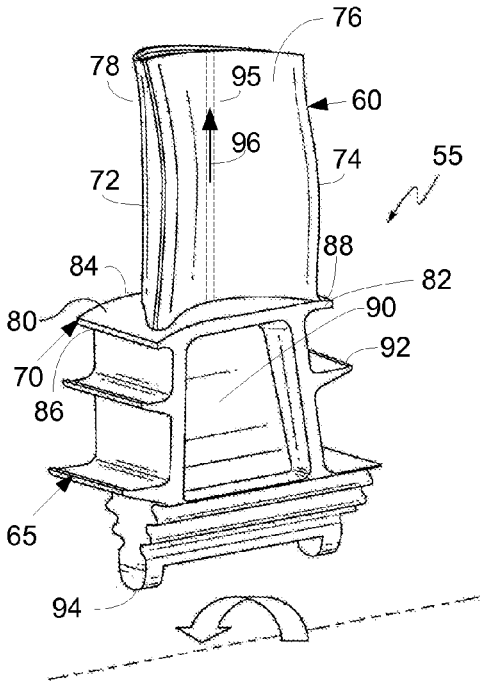
Fig. 2 (Prior Art)
FIG. 2 is a perspective view of a known turbine bucket.
Figure 3:
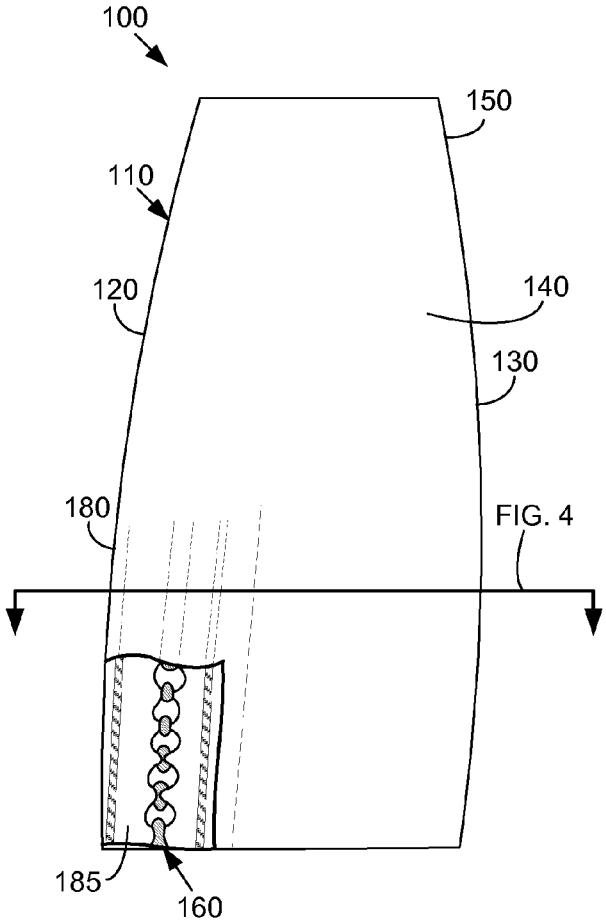
FIG. 3 is a side plan view of an airfoil of a turbine bucket as may be described herein with a cut away view of an internal rib.
Figure 4:
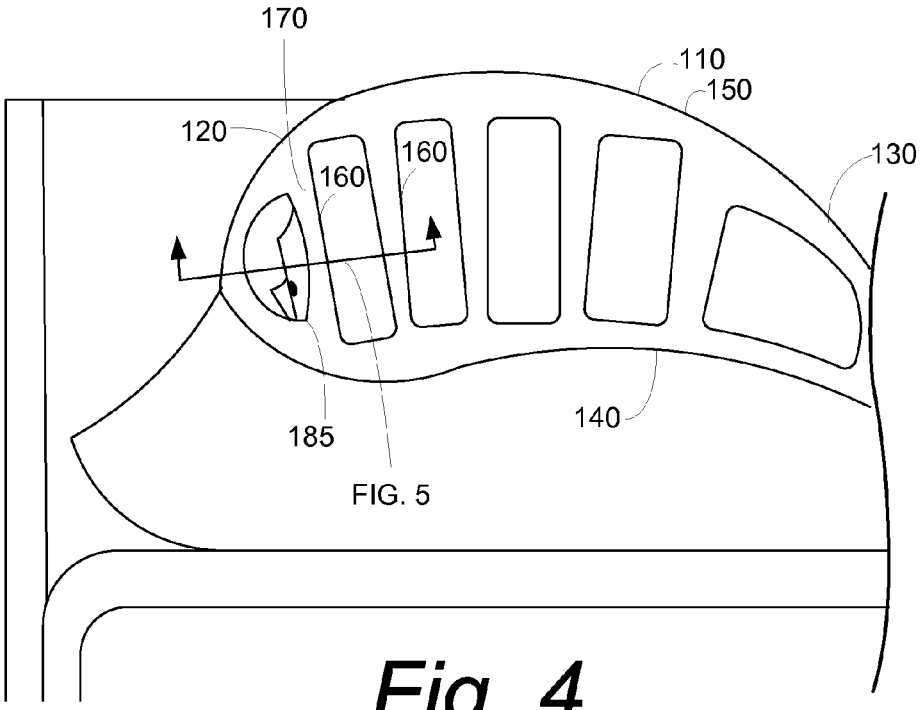
FIG. 4 is a top sectional view of the airfoil of FIG. 3.
Figure 5:
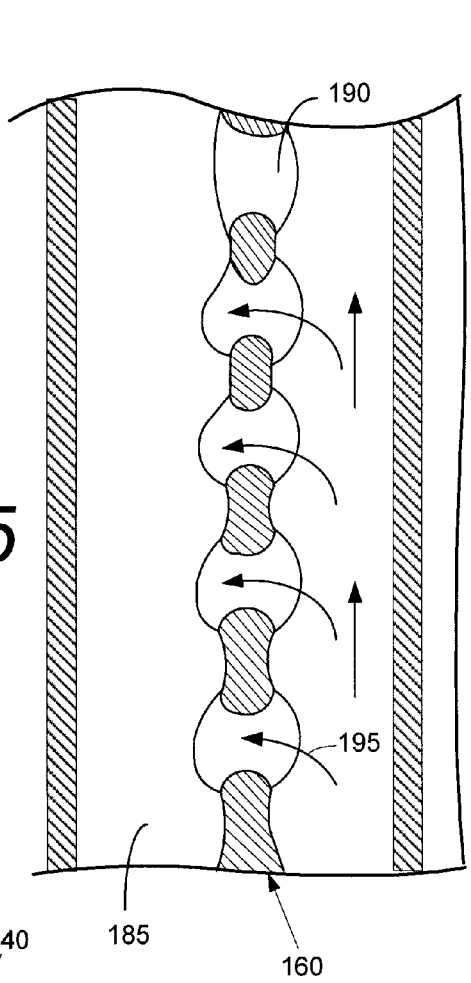
FIG. 5 is a sectional view of a portion of a contoured internal rib for use with the airfoil of FIG. 3.
Figure 6:
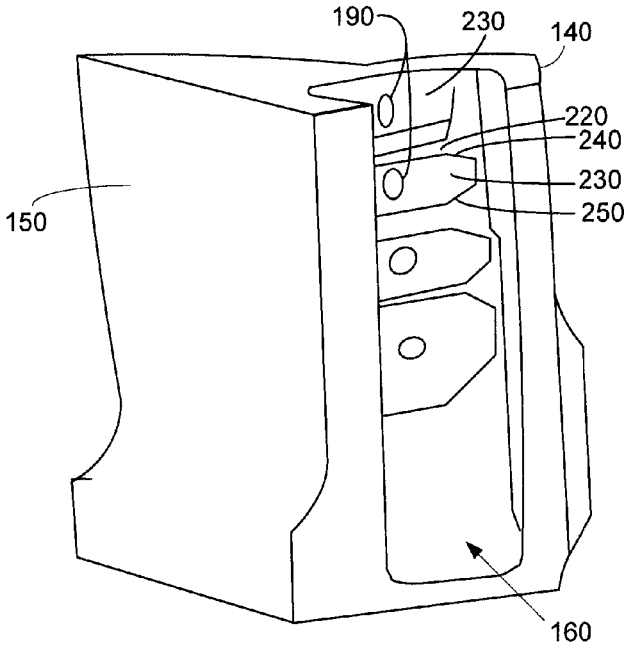
FIG. 6 is a perspective view of a portion of the contoured internal rib for use with the airfoil of FIG. 3.
Figure 7:
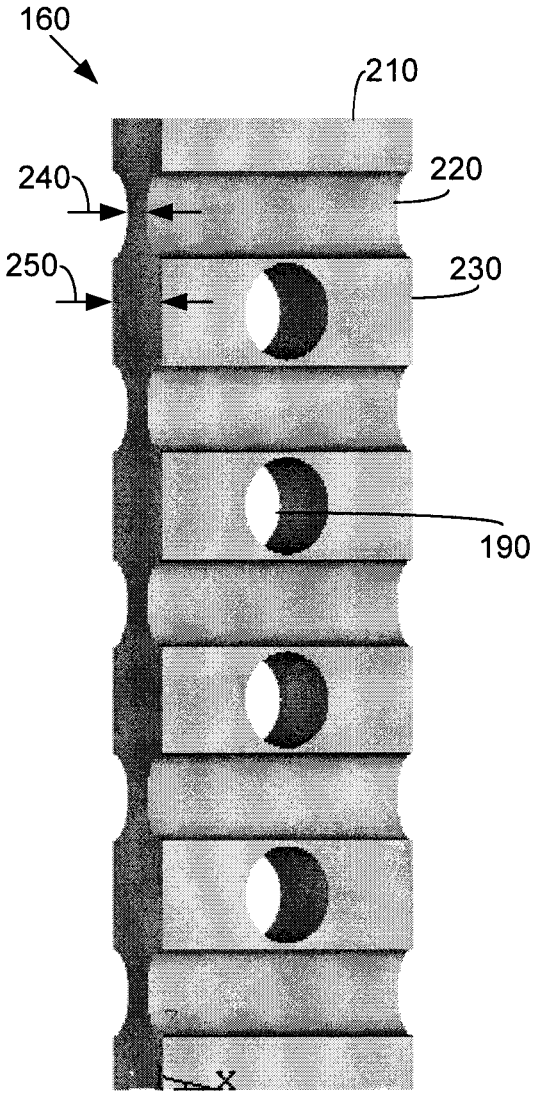
FIG. 7 is a partial sectional view of a portion of the contoured internal rib of FIG. 6.

FIG. 2 shows an example of a turbine bucket 55 that may be used with the turbine 40. Generally described, the turbine bucket 55 includes an airfoil 60, a shank portion 65, and a platform 70 disposed between the airfoil 60 and the shank portion 65. The airfoil 60 generally extends radially upward from the platform 70 and includes a leading edge 72 and a trailing edge 74. The airfoil 60 also may include a concave wall defining a pressure side 76 and a convex wall defining a suction side 78. The platform 70 may be substantially horizontal and planar. Likewise, the platform 70 may include a top surface 80, a pressure face 82, a suction face 84, a forward face 86, and an aft face 88. The top surface 80 of the platform 70 may be exposed to the flow of the hot combustion gases 35. The shank portion 65 may extend radially downward from the platform 70 such that the platform 70 generally defines an interface between the airfoil 60 and the shank portion 65. The shank portion 65 may include a shank cavity 90 therein. The shank portion 65 also may include one or more angle wings 92 and a root structure 94 such as a dovetail and the like. The root structure 94 may be configured to secure the turbine bucket 55 to the shaft 45. Other components and other configurations may be used herein.

The turbine bucket 55 may include one or more cooling circuits 95 extending therethrough for flowing a cooling medium 96 such as air from the compressor 15 or from another source. The cooling circuits 95 and the cooling medium 96 may circulate at least through portions of the airfoil 60, the shank portion 65, and the platform 70 in any order, direction, or route. Many different types of cooling circuits 95 and cooling mediums 96 may be used herein. Specifically, impingement cooling and other types of cooling techniques may be used herein. Other components and other configurations also may be used herein.

FIGS. 3-7 show an example of a turbine bucket 100 as may be described herein. The turbine bucket 100 may include an airfoil 110 similar to that described above. Specifically, the airfoil 110 may extend radially upward from a platform and may include a leading edge 120 and a trailing edge 130. The airfoil 110 also may include a pressure side 140 and a suction side 150. Other components and other configurations may be used herein.

The airfoil 110 of the turbine bucket 100 may have one or more contoured internal ribs 160 therein. Specifically, the internal rib 160 may be a leading edge rib 170 positioned about a leading edge surface 180 of the airfoil 110. Other positions also may be used herein. The internal rib 160 may have a number of through holes 190 extending therethrough. Any number of the through holes 190 may be used herein with any size, shape, or orientation. The through holes 190 may extend along on one side of the internal rib 160 and may extend therethrough in whole or in part towards the opposite side. The through holes 190 may be in communication with a number of cooling cavities 185 for a flow of a cooling medium 195 therethrough.

The internal rib 160 may be in the form of an elongated plate 210. The through holes 190 may be separated from one another along the elongated plate 210 by an in-between space 220. The in-between spaces 220 may vary in number, size, shape, and configuration. Likewise, the through holes 190 may be positioned on the plate 210 in a hole space 230. Likewise, the hole spaces 230 may vary in number, size, shape, and configuration. The in-between spaces 220 may have a first depth 240 while the hole spaces 230 may have a second depth 250. The first depths 240 and the second depths 250 may vary along the length of the elongated plates 210. The first depth 240 is less than the second depth 250, i.e., the in-between space 220 without the through holes 190 has less material along the elongated plate 210 than the hole space 230 with the through holes 190. Other components and other configurations may be used herein.

By having the in-between spaces 220 without the through holes 190 being thinner or having less material than the hole spaces 230 with the through holes 190, the contoured internal rib 160 may have increased strain in the in-between spaces 220 and hence reduced strain in the hole spaces 230. Reducing the strain in the hole spaces 230 may reduce the peak stresses about the through holes 190 so as to improve component lifetime. Improved component lifetime may reduce overall maintenance costs without reducing overall efficiency through requiring an increased cooling flow. The strain caused by thermal gradients thus may be reduced. Moreover, the in-between spaces 220 generally do not have a stress concentration factor ("$K_T$") associated with the through holes 190. Specifically, the strain may be concentrated in the in-between spaces 220 by reducing the thickness and stiffness therein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A turbine bucket, comprising:

a platform; and an airfoil extending from the platform;

the airfoil comprising an internal rib;

the internal rib comprising a plurality of through holes positioned along a plurality of hole spaces and a plurality of in-between spaces;

wherein the plurality of in-between spaces comprises a first depth across an entire width of the internal rib, the plurality of hole spaces comprises a second depth across the entire width of the internal rib, wherein the first depth is less than the second depth, and wherein the width of the internal rib is defined as perpendicular to an axis of the plurality of through holes.

2. The turbine bucket of claim 1, wherein the airfoil comprises a leading edge.

3. The turbine bucket of claim 1, wherein the internal rib comprises a leading edge internal rib.

4. The turbine bucket of claim 1, wherein the airfoil comprises a leading edge surface and wherein the internal rib is positioned adjacent thereto.

5. The turbine bucket of claim 1, wherein the internal rib comprises an elongated plate.

6. The turbine bucket of claim 1, wherein the first depth comprises a first amount of material, the second depth comprises a second amount of material, and wherein the first amount of material is less than the second amount of material.

7. A turbine bucket with a cooling medium flowing therethrough, comprising:

a platform; and an airfoil extending from the platform;

the airfoil comprising an internal rib positioned about a leading edge thereof;

the internal rib comprising a plurality of through holes positioned along a plurality of hole spaces and a plurality of in-between spaces;

wherein the plurality of in-between spaces comprises a first depth across an entire width of the internal rib, the plurality of hole spaces comprises a second depth across the entire width of the internal rib, wherein the first depth is less than the second depth, and wherein the width of the internal rib is defined as perpendicular to an axis of the plurality of through holes.

8. The turbine bucket of claim 7, wherein the internal rib comprises an elongated plate.

9. The turbine bucket of claim 8, wherein the first depth comprises a first amount of material, the second depth comprises a second amount of material, and wherein the first amount of material is less than the second amount of material.

10. A turbine bucket with a cooling medium flowing therethrough, comprising:

a platform; and an airfoil extending from the platform;

the airfoil comprising an internal rib positioned about a leading edge thereof;

the internal rib comprising a plurality of through holes; and the internal rib comprising a plurality of hole spaces with the plurality of through holes therethrough and a plurality of in-between spaces without the plurality of through holes, wherein the hole spaces are thicker across an entire width of the internal rib than the in-between spaces, and wherein the width of the internal rib is defined as perpendicular to an axis of the plurality of through holes.

11. The turbine bucket of claim 10, wherein the internal rib comprises an elongated plate.

* * * * *